US011242856B2

(12) United States Patent
Smith et al.

(10) Patent No.: US 11,242,856 B2
(45) Date of Patent: Feb. 8, 2022

(54) SPRING BIASED PUMP STAGE STACK FOR SUBMERSIBLE WELL PUMP ASSEMBLY

(71) Applicant: Baker Hughes, a GE Company, LLC, Houston, TX (US)

(72) Inventors: Spencer Smith, Claremore, OK (US); Eric Tolley, Claremore, OK (US)

(73) Assignee: BAKER HUGHES HOLDINGS LLC, Houston, TX (US)

( * ) Notice: Subject to any disclaimer, the term of this patent is extended or adjusted under 35 U.S.C. 154(b) by 188 days.

(21) Appl. No.: 16/596,159

(22) Filed: Oct. 8, 2019

(65) Prior Publication Data

US 2020/0116152 A1 Apr. 16, 2020

Related U.S. Application Data

(60) Provisional application No. 62/744,030, filed on Oct. 10, 2018.

(51) Int. Cl.

| | |
|---|---|
| ***F04D 13/10*** | (2006.01) |
| ***F04D 13/08*** | (2006.01) |
| ***F04D 29/041*** | (2006.01) |
| ***F04D 1/06*** | (2006.01) |
| ***E21B 43/12*** | (2006.01) |

(Continued)

(52) U.S. Cl.

CPC ..... *F04D 13/10* (2013.01); *E21B 43/128* (2013.01); *F04D 1/06* (2013.01); *F04D 13/08* (2013.01);

(Continued)

(58) Field of Classification Search

CPC ..... F04D 13/10; F04D 29/0413; F04D 1/06; F04D 1/063; F04D 29/041; F04D 29/628;

(Continued)

(56) References Cited

U.S. PATENT DOCUMENTS 2,688,929 A * 9/1954 Schleyer ..... F04D 29/061 415/175
3,238,879 A * 3/1966 Shallenberg ..... F04D 13/10 415/131

(Continued)

OTHER PUBLICATIONS

International Search Report and Written Opinion for related PCT application PCT/US2019/055308 dated Jan. 23, 2020: pp. 1-8.

(Continued)

*Primary Examiner* — Peter J Bertheaud
(74) *Attorney, Agent, or Firm* — Bracewell LLP; Keith Derrington

(57) ABSTRACT

A submersible well pump has diffusers fixed within the housing and an impeller mounted between each of the diffusers. Spacer sleeves located between and in abutment with hubs of adjacent ones of the impellers define a stack wherein the impellers rotate in unison with the shaft and are axially movable in unison with each other relative to the shaft. A stop shoulder on the shaft abuts the lower end of the stack. A spring mounted in compression around the shaft in abutment with the upper end of the stack urges the lower end of the stack against the stop shoulder. Upward movement of the stack requires further compression of the spring. Up thrust and down thrust gaps between each impeller and adjacent diffusers prevent up thrust and down thrust from being transferred to any of the diffusers.

20 Claims, 4 Drawing Sheets

(51) Int. Cl.
*F04D 29/043* (2006.01)
*F04D 29/042* (2006.01)
*F04D 29/62* (2006.01)

(52) U.S. Cl.
CPC ..... *F04D 29/041* (2013.01); *F04D 29/0413* (2013.01); *F04D 1/063* (2013.01); *F04D 13/086* (2013.01); *F04D 29/042* (2013.01); *F04D 29/043* (2013.01); *F04D 29/628* (2013.01); *Y10S 415/901* (2013.01)

(58) Field of Classification Search
CPC .... F04D 13/086; F04D 29/042; E21B 43/128; Y10S 415/901
See application file for complete search history.

(56) References Cited

U.S. PATENT DOCUMENTS 3,437,046 A * 4/1969 Tremain ..... F04D 13/10 415/214.1
4,621,975 A * 11/1986 Larson ..... F16J 15/162 415/110
5,160,240 A * 11/1992 Wilson ..... F04D 13/10 415/170.1
6,726,449 B2 * 4/2004 James ..... F04D 1/063 415/199.2
8,021,132 B2 * 9/2011 Green ..... F04D 29/606 417/423.6
8,070,426 B2 12/2011 Brunner et al.
2011/0255951 A1 10/2011 Song et al.
2012/0107114 A1 5/2012 Brunner et al.
2016/0201444 A1 7/2016 Hardee et al.
2016/0258441 A1 9/2016 Zheng
2017/0350399 A1 12/2017 Eslinger

OTHER PUBLICATIONS

Examination Report of Canadian Application No. 3,114,800 dated Jul. 12, 2021: pp. 1-6.

* cited by examiner

SPRING BIASED PUMP STAGE STACK FOR SUBMERSIBLE WELL PUMP ASSEMBLY

CROSS REFERENCE TO RELATED APPLICATION

This application claims priority to provisional patent application Ser. No. 62/744,030, filed Oct. 10, 2018.

FIELD OF DISCLOSURE

The present disclosure relates to centrifugal pumps, and in particular to an electrical submersible pump having impellers stacked together by spacer sleeves, the stack being biased by a spring toward a lower end of the pump.

BACKGROUND

Electrical submersible pumps (ESP) are commonly used in hydrocarbon producing wells. An ESP includes a pump driven by an electrical motor. A pump of a typical ESP is a centrifugal type having a large number of stages, each stage having an impeller and a diffuser. The impellers rotate with the shaft relative to the non-rotating diffusers. Spacer sleeves may be located between adjacent ones of the impellers.

In the most common type, the impellers are free to float or move downward and upward a limited distance on the shaft. A down thrust washer between each impeller and the next lower diffuser will transfer down thrust caused by the rotation of the impeller to the next lower diffuser. Typically, an up thrust washer between each impeller and the next upward diffuser will transfer any up thrust that may be caused by rotation of the impellers.

While these types of pumps are very successful, some wells produce a large amount of fine, sharp sand particles in the well fluid. The sand particles can rapidly wear the stages of the pump. In some pumps, the components in rotating sliding engagement with each other are formed of abrasion resistant materials, such as tungsten carbide sleeves, bushings, and thrust washers. Even with abrasion resistant components, rapid wear can still occur.

A compression pump is another type of centrifugal well pump used particularly in sandy wells. In a compression pump, the impellers are fixed to the shaft both axially and rotationally. The impellers are assembled precisely so that during normal operation, they cannot transfer either up thrust or down thrust to the adjacent diffusers. All of the thrust of the impellers transfers to the shaft, and none to the diffusers. Consequently, thrust washers are not employed. While a compression pump may better resist wear from sand particles than a floating impeller type, they are more costly to assemble.

SUMMARY

A submersible well pump comprises a housing, a rotatable drive shaft extending along a longitudinal axis of the housing, a plurality of diffusers mounted within the housing for non-rotation relative to the housing and a plurality of impellers, each of the impellers being between two of the diffusers. The pump includes means for mounting the impellers in a stack such that the impellers rotate in unison with the shaft and are axially movable in unison with each other relative to the shaft in response to thrust created by each of the impellers. A stop shoulder on the shaft abuts a first end of the stack, enabling thrust caused by the impellers in a first direction to transfer through the stop shoulder to the shaft.

A spring mounted to the shaft in abutment with a second end of the stack is axially compressible to allow the stack to move axially relative to the shaft in a second direction, enabling thrust caused by the impellers in a second direction to transfer through the spring to the shaft.

In the embodiment shown, the first direction is an upstream direction. Thrust in the first direction is down thrust. The second direction is a downstream direction, and thrust in the second direction is up thrust.

A first direction gap exists between each of the impellers and an adjacent one of the diffusers in the first direction. The first direction gap prevents thrust caused by each of the impellers in the first direction from transferring to the adjacent one of the diffusers in the first direction.

A second direction gap exists between each of the impellers and an adjacent one of the diffusers in the second direction. The second direction gap prevents thrust caused by each of the impellers in the second direction from transferring to the adjacent one of the diffusers in the second direction. Axial movement of the stack in the second direction in response to thrust in the second direction decreases the second direction gap and increases the first direction gap.

Stated in another manner, an upstream gap exists between each of the impellers and an adjacent upstream one of the diffusers, preventing thrust caused by each of the impellers in an upstream direction from transferring to the adjacent upstream one of the diffusers. A downstream gap exists between each of the impellers and an adjacent downstream one of the diffusers, preventing thrust caused by each of the impellers in a downstream direction from transferring to the adjacent downstream one of the diffusers.

The upstream gap and the downstream gap of each of the impellers have preset dimensions prior to operation of the pump. In the embodiment shown, the preset dimension of the upstream gap of each of the impellers is larger than the preset dimension of the downstream gap of each of the impellers.

In the embodiment shown, the means for mounting the impellers in a stack comprises spacer sleeves interspersed between each of the impellers.

Figure 1:
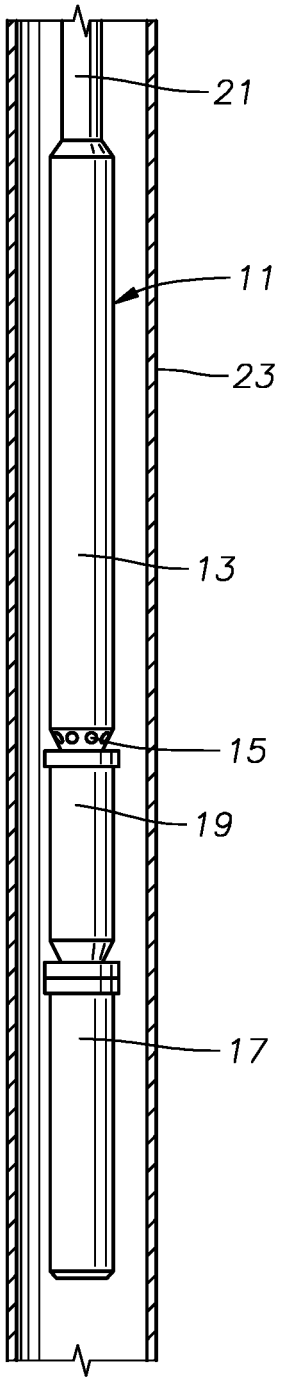
FIG. 1 is an side view of an electrical submersible pump (ESP) having a pump in accordance with this disclosure.

While the disclosure will be described in connection with the preferred embodiments, it will be understood that it is not intended to limit the disclosure to that embodiment. On the contrary, it is intended to cover all alternatives, modifications, and equivalents, as may be included within the scope of the claims.

DETAILED DESCRIPTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 illustrates an electrical submersible well pump (ESP) 11 of a type commonly used to lift hydrocarbon production fluids from wells. ESP 11 has a centrifugal pump 13 with intake ports 15 for drawing in well fluid. Pump 13 could be made up of several similar pumps secured together in tandem by threaded fasteners or bolts, with intake ports 15 being at the lowermost pump. Intake ports 15 could also be in a separate module connected to pump 13. Further, if a rotary gas separator is employed below pump 13, intake ports 15 would be in the gas separator.

An electrical motor 17 operatively mounts to and drives pump 13. Motor 17 contains a dielectric lubricant for lubricating the bearings within. A pressure equalizer or seal section 19 communicates with the lubricant in motor 17 and with the well fluid for reducing a pressure differential between the lubricant in motor 17 and the exterior well fluid. In this example, the pressure equalizing portion of seal section 19 locates between motor 17 and pump intake 15. Alternately, the pressure equalizing portion of seal section 19 could be located below motor 17 and other portions of seal section 19 above motor 17. The terms "upward", "downward", "above", "below" and the like are used only for convenience as ESP 11 may be operated in other orientations, such as horizontal.

A string of production tubing 21 suspended within casing 23 supports ESP 11. In this example, pump 13 discharges into production tubing 21. Alternately, coiled tubing could support ESP 11, in which case, pump 13 would discharge into the annulus around the coiled tubing. Motor 17 in that case would be located above pump 13. The power cable for motor 17 would be within the coiled tubing instead of alongside production tubing 21.

Figure 2A:
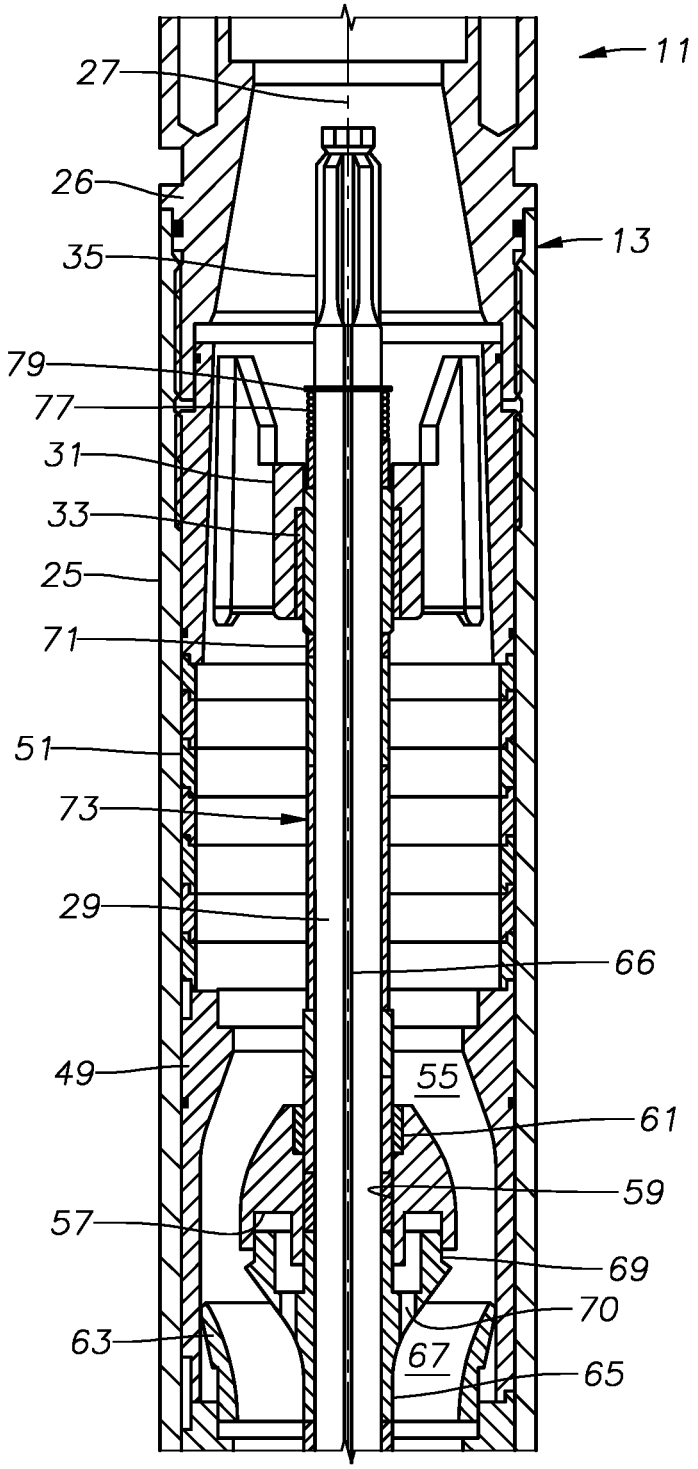
FIGS. 2A and 2B comprise an axial sectional view of the pump of FIG. 1.
Figure 2B:
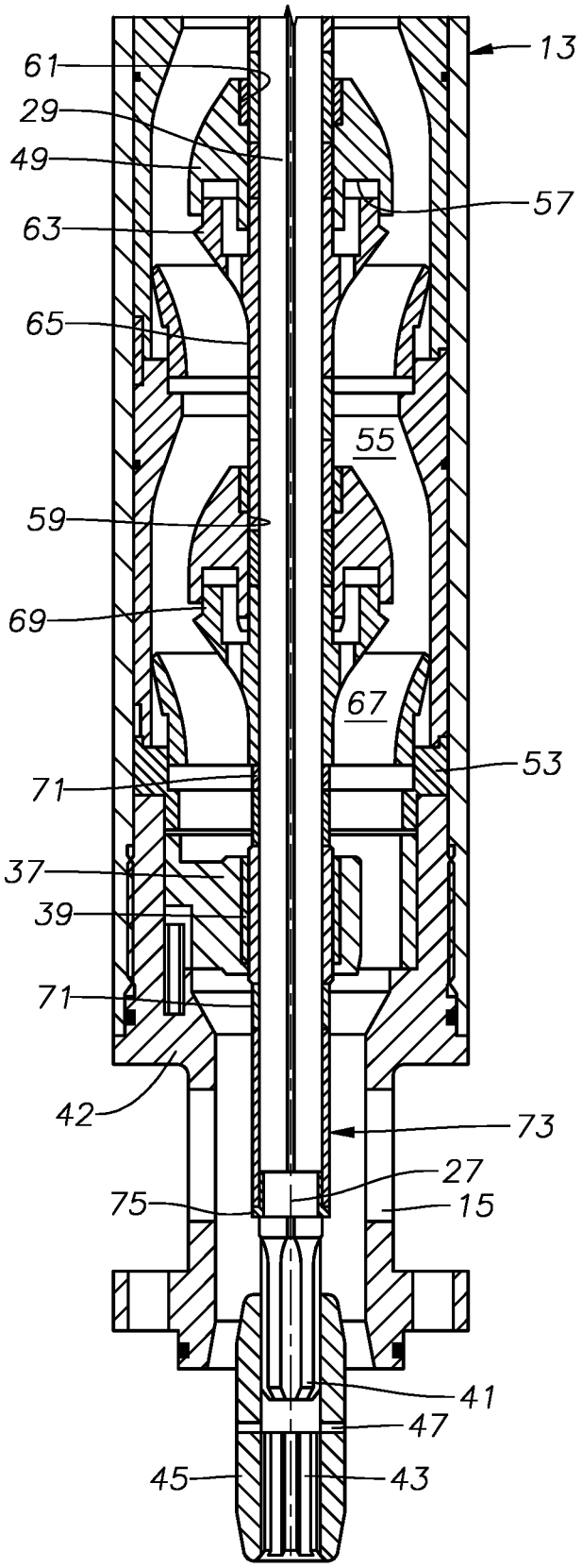

Referring to FIGS. 2A and 2B, pump 13 has a tubular housing 25 with a longitudinal axis 27. An upper adapter 26 connects housing 25 to a discharge head of ESP 11 or to another pump (not shown), which may be constructed the same as pump 13. A rotatable driven shaft 29, driven by motor 17 (FIG. 1), extends within housing 25 along axis 27. A conventional upper radial bearing 31 provides radial support for driven shaft 29 near upper adapter 26. Upper radial bearing 31 has threads on its outer diameter that secure to threads in the bore of housing 25. Upper radial bearing 31 has a non-rotating bushing 33 that may be formed of a hard abrasion-resistant material, such as tungsten carbide. Driven shaft 29 may have an upper splined end 35 for connecting to another pump (not shown) for tandem operation or to seal section 19 if motor 17 is located above.

Similarly, as shown in FIG. 2B, a conventional lower radial bearing 37 provides radial support for a lower end of driven shaft 29. Lower radial bearing 37 may also have a non-rotating tungsten carbide bushing 39. Driven shaft 29 has a lower splined end 41 within a lower adapter 42. In this example, lower adapter 42 bolts to seal section 19 (FIG. 1), and intake ports 15 are located in lower adapter 42. Alternately, lower adapter 42 could connect pump 13 to another module, such as another pump or a gas separator (not shown). An upper splined end of a drive shaft assembly 43 within seal section 19 and motor 17 couples with an internally-splined coupling 45 to pump driven shaft 29 for rotation in unison. Down thrust on pump driven shaft 29, which is in an upstream direction or first direction, transfers to drive shaft assembly 43 by various arrangements, such as a shim or other thrust transfer member 47 in coupling 45.

Pump 13 has a large number of diffusers 49 that seal to the inner diameter of housing 25. Diffusers 49 are pre-loaded into abutment with each other by upper radial bearing 31 and secured in various manners to prevent rotation within housing 25. Cylindrical diffuser spacers 51 may be stacked on each other between the uppermost diffuser 49 and upper radial bearing 31. A base 53 may locate between the lowermost diffuser 49 and lower adapter 42. Each diffuser 49 has flow passages 55 that extend upward and inward from a lower inlet to an upper outlet. Also, each diffuser 49 has a downward-facing balance ring cavity 57 on its lower side. Each diffuser 49 has a shaft passage or bore 59 through which driven shaft 29 extends. In this embodiment, bore 59 of each diffuser 49 has on its upper side an abrasion-resistant bushing 61 mounted for non-rotation in a receptacle.

Pump 13 has a large number of impellers 63, each located between two of the diffusers 49. Each impeller 63 has a cylindrical hub 65 through which driven shaft 29 extends. In this embodiment, driven shaft 29 has an axially extending slot containing a key 66 that engages a mating slot in each impeller hub 65. This key and slot arrangement causes hubs 65 to rotate in unison with driven shaft 29 but allows hubs 65 to move axially a short distance relative to driven shaft 29. Each impeller 63 has flow passages 67 that extend upward and outward from a lower inlet to an upper outlet. Diffuser and impeller flow passages 55, 67 are illustrated as a mixed flow type; alternately, they could be a radial flow type.

Each impeller 63 has an upward extending, cylindrical balance ring 69 on its upper side that rotates in sliding engagement with an inward-facing wall of balance ring cavity 57 of the next upward diffuser 49. Each impeller 63 may have balance holes 70 that extend from impeller flow passages 67 into communication with balance ring cavity 57.

A number of spacer sleeves 71 extend upward from the uppermost impeller 63 through upper radial bearing 31. At least one spacer sleeve 71 also extends between the lower end of each impeller hub 65 and the upper end of the impeller hub 65 of the next lower impeller 63. One or more spacer sleeves 71 also extends downward from the lowermost impeller 63 to a point near drive shaft lower splined end 41. Each spacer sleeve 71 is a cylindrical metal tube through which shaft 29 extends; each spacer sleeve has a slot (not shown) within its inner diameter for engaging drive shaft key 66. Some of the spacer sleeves 71 that are in sliding, rotating engagement with upper radial bearing bushing 33, lower radial bearing bushing 39, and diffuser bushings 61. Some or all of the spacer sleeves 71 may be formed of an abrasion-resistant material, such as tungsten carbide. Spacer sleeves 71 may be considered to be a part of each impeller hub 65.

Spacer sleeves 71 form an impeller stack 73 by being in abutment with each other and with impeller hubs 65. The entire impeller stack 73 can move axially a short distance as a unit on driven shaft 29. However, the individual spacer sleeves 71 and impellers 63 cannot move axially relative to each other. The lower or first end of impeller stack 73, which comprises in this example one of the spacer sleeves 71, abuts a stop shoulder or ring 75 fixed on driven shaft 29. Stop ring 75 provides a lower limit for any further downward movement of impeller stack 73 on driven shaft 29. The second or upper end of impeller stack 73, which also comprises one of the spacer sleeves 71 in this example, abuts the lower end of a spring 77.

Figure 3:
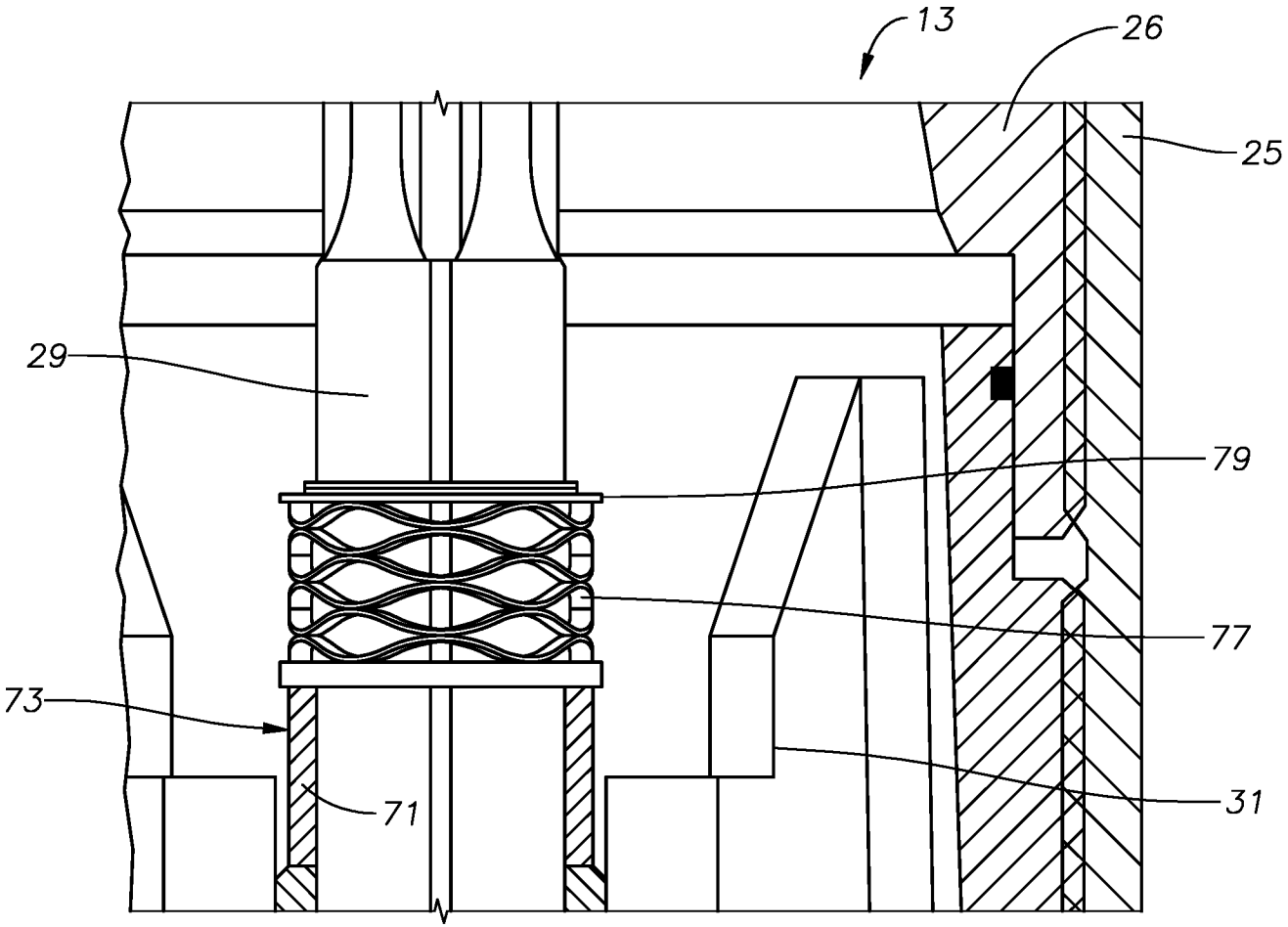
FIG. 3 is an enlarged sectional view of a portion of the pump containing a spring that biases a stack of impellers.

Referring to FIG. 3, spring 77, which is located above upper radial bearing 31 and encircles shaft 29, has an upper end fixed to driven shaft 29 by a retaining ring 79 engaging a circumferential groove on driven shaft 29. The first or upper end of impeller stack 73 abuts the lower end of spring 77, which compresses spring 77 to a selected initial set position prior to operation of pump 13. Spring 77 rotates in unison with impeller stack 73 and driven shaft 29.

During assembly, a technician will compress the original axial dimension of spring 77 by forcing spring 77 downward against impeller stack 73, then installing retaining ring 79. Spring 77 will exert a downward or first direction bias force on impeller stack 73, which is reacted against by stop ring 75. Spring 77 may be of various types and is illustrated as a wave spring. Spring 77 provides a limit for upward movement of stack 73 on shaft 29. Spring 77 also restrains any of the impellers 63 from moving axially relative to the other impellers 63.

Figure 4:
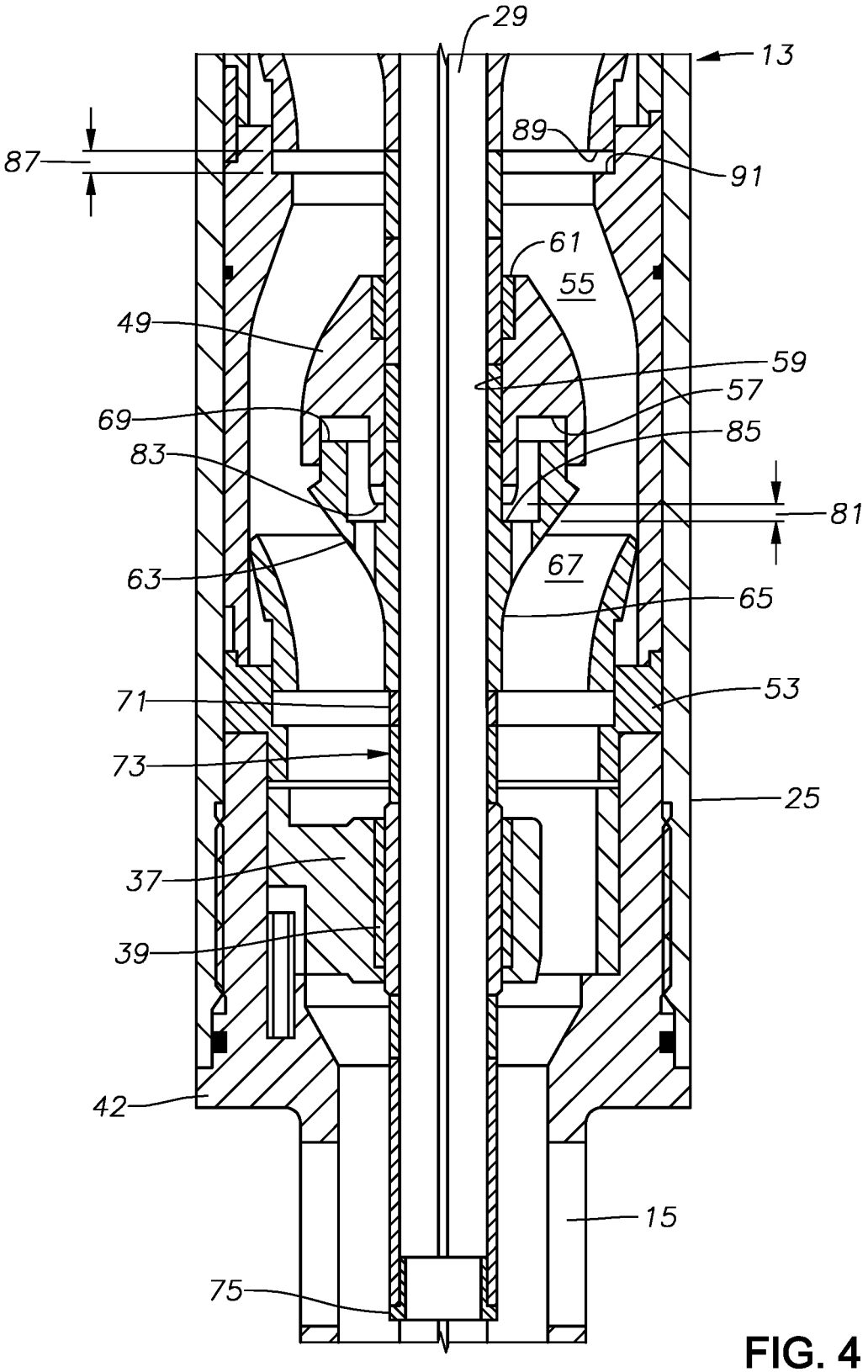
FIG. 4 is a partial, enlarged sectional view of a lower portion of the pump shown in FIG. 2B.

Referring to FIG. 4, during assembly, each impeller 63 and spacer sleeve 71 will be assembled on driven shaft 29 in an initial running or set position between two of the diffusers 49. In this initial set position, an up, second direction, or downstream thrust gap 81 will be located between a downward-facing surface 83 of one of the diffusers 49 and the nearest upward-facing surface 85 of one of the impellers 63. The downward-facing surface 83 faces upstream, and the upward facing surface 85 faces downstream. Up thrust gap 81 is the smallest axial distance between any upward-facing part of impeller 63 and any aligned downward-facing part of diffuser 49.

In other words, if impeller 63 were free to move upward an axial distance equal to up thrust gap 85, which it isn't, up thrust gap 81 would close and downward-facing surface 83 would contact upward facing surface 85 before any other portion of impeller 63 would abut any aligned portion of its mating diffuser 49. Stop ring 75 prevents any downward movement of impeller stack 73 while in the initial preset position prior to operation, preventing up thrust gap 81 from increasing in dimension from its initial operational position.

If impellers 63 experience up thrust during operation, spring 77 (FIG. 3) can compress more than its initial set position, thus impeller stack 73 could move upward slightly. The up thrust from stack 73 will transfer through spring 77 to driven shaft 29. This upward movement would decrease the dimensions of up thrust gaps 81. However, spring 77 is designed to not compress enough to allow up thrust gaps 81 to completely close. Up thrust gaps 81 in the various stages of impellers 63 and diffusers 49 are not identical to each other because of tolerances. There is no structure, such as a thrust washer, between downward-facing surface 83 and upward-facing surface 85, that could transfer any up thrust of any impeller 63 to any diffuser 49. Rather, all up thrust, if any occurs, will transfer from each impeller 63 through impeller stack 73 and spring 77 to driven shaft 29.

The assembling technician will also provide an upstream or down thrust gap 87 with an initial running or preset dimension. Down thrust gap 87 is the initial axial distance between a downward-facing surface 89 of each impeller 63 and an adjacent upward-facing surface 91 of the next lower diffuser 49. If impeller stack 73 were free to move downward from the initial operational position, which it isn't, down thrust gap 87 would decrease and close before any other portion of impeller 63 would abut any portion of its mating diffuser 49. Stop ring 75 prevents any decreases in the preset dimension of down thrust gap 87. In the example mentioned above, spring 77 allows some upward movement of impeller stack 73 from the initial preset position if up thrust occurs; the upward movement would increase the preset dimension of down thrust gap 87.

There is no structure between downward-facing surface 89 and upward-facing surface 91, such as a thrust washer, that could transfer down thrust from any impeller 63 to a next lower diffuser 49. All down thrust caused by the rotation of each impeller 63 transfers through impeller stack 73 to stop ring 75 and driven shaft 29. Down thrust imposed on driven shaft 29 transfers to drive shaft assembly 43 (FIG. 2B) of seal section 19 and motor 17. The dimensions of down thrust gaps 87 in the various stages of impeller stack 73 may vary from each other.

In one example, up thrust gap 81 is 0.121 inch and down thrust gap 81 is 0.175 inch in the initial preset position. Those gaps would contain thrust washers in conventional floating impeller pump stages. Eliminating up thrust and down thrust washers, as in this disclosure, avoids wear in these areas due to high sand content in the well fluid. Abutting the impellers 63 with spacer sleeves 71 into a stack that can axially move in unison a limited distance on the drive shaft avoids the complexity of a compression pump having the impellers fixed to the drive shaft against any axial movement.

During operation, spring 77 will apply a downward compressive force to impeller stack 73. The compressive force influences abrasives in the well fluid, tending to cause the abrasives to flow up impeller passages 67 and diffuser passages 55, rather than flowing in between drive shaft 29 and the components of impeller stack 73. Spring 77 also enables thermal growth of impeller stack 73 relative to shaft 29 and housing 25 when the well fluid temperatures are high.

The present disclosure described herein, therefore, is well adapted to carry out the objects and attain the ends and advantages mentioned, as well as others inherent therein. While two embodiments of the disclosure have been given for purposes of disclosure, numerous changes exist in the details of procedures for accomplishing the desired results. These and other similar modifications will readily suggest themselves to those skilled in the art, and are intended to be encompassed within the scope of the appended claims.

The invention claimed is:

1. A submersible well pump, comprising:

a housing;

a rotatable drive shaft extending along a longitudinal axis of the housing;

a plurality of diffusers mounted within the housing;

a plurality of impellers, each of the impellers having a hub with an axial hub passage through which the shaft passes;

means for mounting the impellers in a stack such that the impellers rotate in unison with the shaft and are axially movable in unison with each other relative to the shaft in response to thrust created by each of the impellers;

spacer sleeves located between and in abutment with the hubs of adjacent ones of the impellers, the spacer sleeves and the impellers defining a stack wherein the impellers rotate in unison with the shaft and are axially movable in unison with each other relative to the shaft;

a stop shoulder on the shaft that is in abutment with a first end of the stack, enabling thrust caused by the impellers in a first direction to transfer through the stop shoulder to the shaft; and a spring mounted to the shaft in abutment with a second end of the stack, so that when the spring is axially compressed the first end of the stack is urged against the stop shoulder and the spacer sleeves are in abutting contact with hubs of adjacent ones of the impellers.

2. The pump according to claim 1, further comprising:

a first direction gap between each of the impellers and an adjacent one of the diffusers in the first direction, preventing thrust caused by each of the impellers in the first direction from transferring to the adjacent one of the diffusers in the first direction.

3. The pump according to claim 1, further comprising:

a second direction gap between each of the impellers and an adjacent one of the diffusers in the second direction, preventing thrust caused by each of the impellers in the second direction from transferring to the adjacent one of the diffusers in the second direction.

4. The pump according to claim 1, further comprising:

an upstream gap between each of the impellers and an adjacent upstream one of the diffusers, preventing thrust caused by each of the impellers in an upstream direction from transferring to the adjacent upstream one of the diffusers; and a downstream gap between each of the impellers and an adjacent downstream one of the diffusers, preventing thrust caused by each of the impellers in a downstream direction from transferring to the adjacent downstream one of the diffusers.

5. The pump according to claim 4, wherein:

the upstream gap and the downstream gap of each of the impellers have preset dimensions prior to operation of the pump; and the preset dimension of the upstream gap of each of the impellers is larger than the preset dimension of the downstream gap of each of the impellers.

6. The pump according to claim 1, further comprising:

a first direction gap between each of the impellers and an adjacent one of the diffusers in the first direction, preventing thrust caused by each of the impellers in the first direction from transferring to the adjacent one of the diffusers in the first direction;

a second direction gap between each of the impellers and an adjacent one of the diffusers in the second direction, preventing thrust caused by each of the impellers in the second direction from transferring to the adjacent one of the diffusers in the second direction;

wherein axial movement of the stack in the second direction in response to thrust in the second direction decreases the second direction gap and increases the first direction gap.

7. The pump according to claim 1, wherein:

the first direction is an upstream direction;

thrust in the first direction is down thrust;

the second direction is a downstream direction; and thrust in the second direction is up thrust.

8. The pump according to claim 1, wherein the means for mounting the impellers comprises spacer sleeves interspersed between each of the impellers.

9. A submersible well pump, comprising:

a housing;

a rotatable drive shaft extending along a longitudinal axis of the housing;

a plurality of diffusers fixed within the housing for non-movement relative to the housing;

a plurality of impellers, that each have a hub with an axial hub passage through which the shaft passes;

spacer sleeves located between and in abutment with the hubs of adjacent ones of the impellers, the spacer sleeves and the impellers defining a stack wherein the impellers rotate in unison with the shaft and are axially movable in unison with each other relative to the shaft;

a stop shoulder on the shaft, a first end of the stack being in abutment with the stop shoulder, providing a first direction limit for axial movement relative to the shaft in the first direction;

a spring mounted in compression around the shaft in abutment with a second end of the stack, the spring urging the first end of the stack against the stop shoulder and urging the spacer sleeves to remain in abutment with the hubs of adjacent ones of the impellers; and wherein movement of the stack in the second direction relative to the shaft requires further compression of the spring.

10. The pump according to claim 9, wherein the first end of the stack is upstream from the second end of the stack.

11. The pump according to claim 9, further comprising:

an axial up thrust gap between a downstream facing surface of each of the impellers and an upstream facing surface of an adjacent downstream one of the diffusers that is free of any structure that would transfer up thrust between each of the impellers to the adjacent downstream one of the diffusers.

12. The pump according to claim 11, wherein further compression of the spring from an initial set position in response to axial movement of the stack relative to the shaft reduces but does not close the up thrust gap.

13. The pump according to claim 9, further comprising:

an axial down thrust gap between an upstream facing surface of each of the impellers and a downstream facing surface of an adjacent upstream one of the diffusers that is free of any structure that would transfer down thrust between each of the impellers to the adjacent upstream one of the diffusers.

14. The pump according to claim 13, wherein further compression of the spring from an initial set position in response to axial movement of the stack relative to the shaft increases the down thrust gap from an initial set position.

15. The pump according to claim 9, wherein all down thrust caused by operation of the impellers transfers to the stop shoulder and to the shaft.

16. A submersible well pump assembly, comprising:

an electrical motor having a drive shaft assembly;

a pump driven by the drive shaft assembly of the motor, the pump comprising:

a housing;

a driven shaft within the housing extending along a longitudinal axis of the housing, the driven shaft being rotated by the drive shaft;

a plurality of diffusers immovably fixed within the housing;

a stack of impellers that rotates in unison with the driven shaft, each of the impellers having a hub with an axial hub passage through which the driven shaft passes;

spacer sleeves being located between and in abutment with the hubs of adjacent ones of the impellers in the stack;

a stop shoulder on the driven shaft, a lower end of the stack being in abutment with the stop shoulder, wherein down thrust exerted by the impellers within the stack transfers through the spacer sleeves to the stop shoulder and from the stop shoulder to the driven shaft;

a spring mounted around the driven shaft, the spring having an upper end axially fixed to the driven shaft and a lower end in abutment with an upper end of the stack, the spring urging the stack against the stop shoulder and preventing axial movement of the impellers within the stack relative to each other;

a down thrust gap between each of the impellers and a next lower one of the diffusers, each of the down thrust gaps having a preset down thrust dimension with the lower end of the stack being in abutment with the stop shoulder, each of the down thrust gaps being free of any structure that would cause down thrust of each of the impellers to transfer to one of the diffusers;

an up thrust gap between each of the impellers and a next upper one of the diffusers, each of the up thrust gaps having a preset up thrust dimension with the lower end of the stack being in abutment with the stop shoulder, each of the up thrust gaps being free of any structure that would cause up thrust of each of the impellers to transfer to one of the diffusers; and wherein up thrust incurred by the impellers causes the stack to move upward in unison, further compressing the spring and transferring up thrust of the impellers through the spring to the driven shaft.

17. The pump assembly according to claim 16, wherein the preset down thrust dimensions are greater than the preset up thrust dimensions.

18. The pump assembly according to claim 16, wherein the spring comprises an annular wave spring.

19. The pump assembly according to claim 16, further comprising:

a splined lower end on the driven shaft;

a coupling having internal splines that couple the driven shaft to the drive shaft assembly; and a thrust transfer member between a lower end of the driven shaft and an upper end of the drive shaft for transferring down thrust on the driven shaft to the drive shaft assembly.

20. The pump assembly according to claim 16, wherein upward movement of the stack on the shaft increases the preset down thrust dimension of each of the impellers and decreases the preset up thrust dimension of each of the impellers.

* * * * *